US008944397B2

(12) United States Patent
Brown et al.

(10) Patent No.: US 8,944,397 B2
(45) Date of Patent: Feb. 3, 2015

(54) UNIVERSAL HVAC COMPONENT MOUNTING SYSTEMS

(76) Inventors: Rodger A. Brown, Beaverton, OR (US); Jayson Dougherty, Estacada, OR (US); EuGene A. Foidel, Oregon City, OR (US)

( * ) Notice: Subject to any disclaimer, the term of this patent is extended or adjusted under 35 U.S.C. 154(b) by 315 days.

(21) Appl. No.: 13/559,413

(22) Filed: Jul. 26, 2012

(65) Prior Publication Data

US 2014/0027587 A1 Jan. 30, 2014

(51) Int. Cl.
*A47F 5/00* (2006.01)

(52) U.S. Cl.
USPC ..... 248/298.1; 248/274.1; 248/276.1; 248/346.07

(58) Field of Classification Search
USPC ..... 248/201, 274.1, 276.1, 295.11, 298.1, 248/205.1, 223.41, 342, 346.07, 309.1; 403/345, 377; 165/78; 110/349; 454/331, 332, 334
See application file for complete search history.

(56) References Cited

U.S. PATENT DOCUMENTS

| | | | | | |
|---|---|---|---|---|---|
| 1,979,543 | A * | 11/1934 | Heasley | 454/331 |
| 4,406,216 | A * | 9/1983 | Hott et al. | 454/349 |
| 4,997,364 | A * | 3/1991 | McGrath et al. | 432/59 |
| 5,815,932 | A * | 10/1998 | Presher et al. | 30/373 |
| 6,488,256 | B1 * | 12/2002 | Chang | 248/670 |
| 6,827,140 | B2 * | 12/2004 | Lin | 165/185 |
| 2003/0177724 | A1 * | 9/2003 | Botting | 52/302.1 |
| 2007/0123161 | A1 * | 5/2007 | Pilger | 454/331 |
| 2010/0282933 | A1 * | 11/2010 | Phillips | 248/218.4 |

* cited by examiner

*Primary Examiner* — Todd M Epps
(74) *Attorney, Agent, or Firm* — Mohr Intellectual Property Law Solutions, PC

(57) ABSTRACT

Universal systems for mounting HVAC components within an HVAC system where the component mounting system defines a platform comprised of slidingly engaging rail sections. Each of the rail sections include support brackets, from which, in some examples, extend a receiving member or an inserting member configured to engage a receiving member or an inserting member of an adjacent rail section. In particular embodiments, platform sections include arms having channels and arms having glides each glide being configured to slidingly engage the channel of an adjacent platform section allowing platform sections to adjust the effective length and width of the platform.

23 Claims, 6 Drawing Sheets

UNIVERSAL HVAC COMPONENT MOUNTING SYSTEMS

BACKGROUND

The present disclosure relates generally to support systems for mounting heating, ventilation, and air conditioning (HVAC) components. In particular, universal HVAC component support systems with slidingly engaged bracket members are described.

Known methods and devices for mounting HVAC components within existing ductwork are not entirely satisfactory for the range of applications in which they are employed. For example, existing mounting systems fail to adequately address the wide range of duct and furnace housing sizes to which HVAC components must be mounted. A significant problem faced by HVAC installers is anticipating the size of various styles and brands of plenum, air handlers, filter boxes, furnace housing, and the like.

The variations in size and type of HVAC components and ductwork forces installers to custom make mounting hardware in the field. This process is time consuming, expensive, inefficient, and does not result in accurate work. Installers cannot quickly and accurately install components because equipment models and sizes vary so widely and conventional systems cannot be adjusted in the field to fit the range of applications.

Existing systems are also application specific. A mounting system adapted to install an A-Coil in a plenum for example, would not necessarily fit when mounted inside of a furnace. Likewise a system for mounting components in a furnace would not necessarily be adaptable for use in an air handler. This lack of interchangeability between HVAC component mounting systems causes delays in installations and repairs. Installers are required to have a large inventory of materials on hand for making field adaptations which, with adequate mounting systems, would become superfluous.

Current systems also fail to overcome problems presented in physically connecting the component mounting systems within the various ductwork and housing. Most often the mounting rails are screwed to the housing with a number of sheet-metal screws. In order to accomplish this, an installer is forced to do a number of tasks, such as, aligning the mounting system, and pre-drilling the plenum or air handler to receive the mounting screws. Much of this is done in cramped quarters, adding to the time requirements and costs of installations.

Thus, there exists a need for HVAC component mounting systems that improve upon and advance the design of known systems. Examples of new and useful HVAC component mounting systems relevant to the needs existing in the field are discussed below.

SUMMARY

The present disclosure is directed to universal systems for mounting HVAC components within an HVAC system where the component mounting system defines a platform comprised of slidingly engaging rail sections. Each of the rail sections include support brackets, from which, in some examples, extend a receiving member or an inserting member configured to engage a receiving member or an inserting member of an adjacent rail section. In particular embodiments, platform sections include arms having channels and arms having glides each glide being configured to slidingly engage the channel of an adjacent platform section.

DETAILED DESCRIPTION

Figure 1:
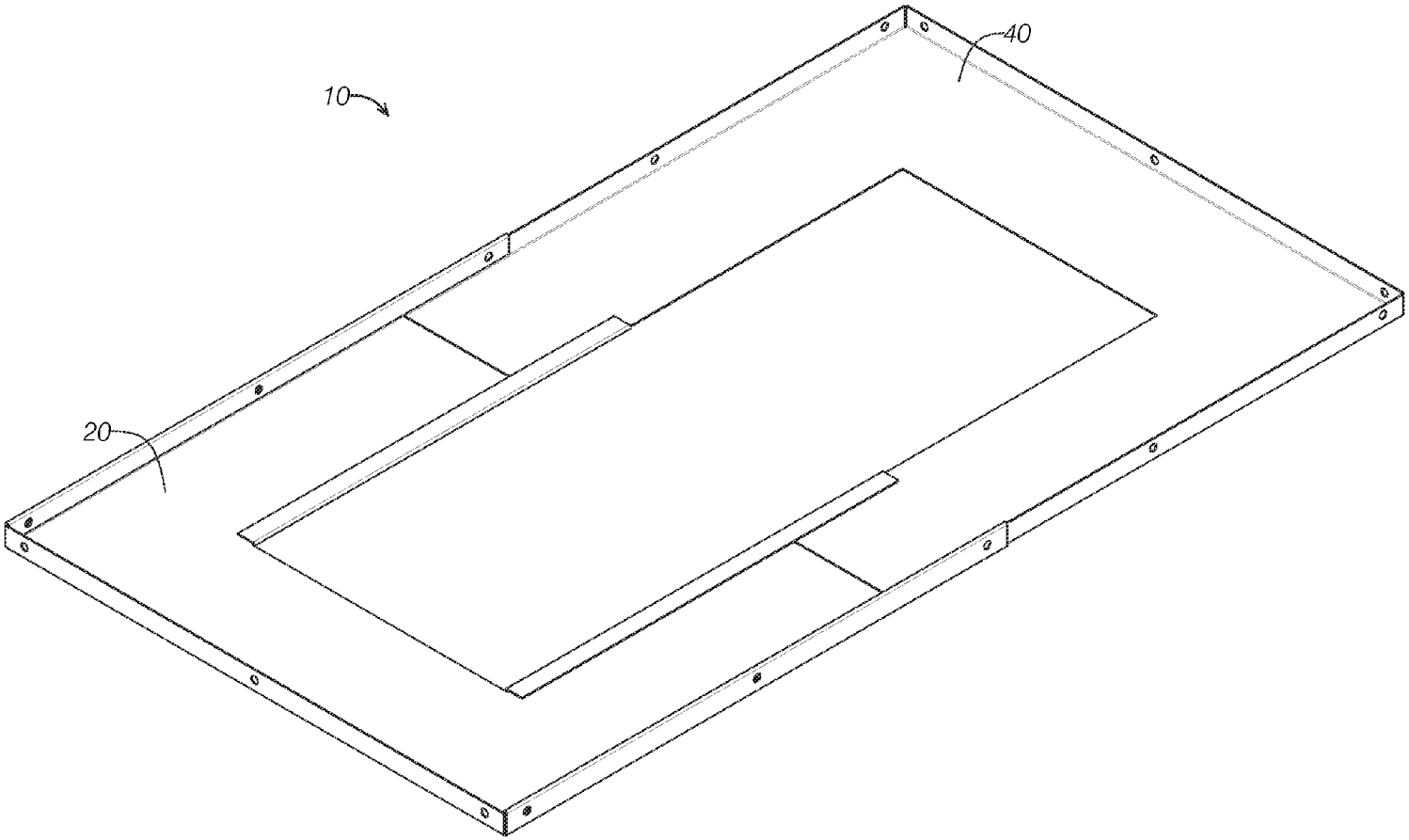
FIG. 1 is a perspective view of a first example of a universal HVAC component mounting system.

The disclosed universal HVAC component mounting systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various component mounting systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-6, a first example of a universal HVAC component mounting system 10 will now be described. Mounting system 10 includes a first rail section 20 having a central opening 22, a first support bracket 24 which extends on a first axis 65, a first receiving member 26 which extends on a second axis 66, and a second receiving member 28. Mounting system 10 further includes a second rail section 40) having a central opening 42, a second support bracket 44, a first inserting member 46, and a second inserting member 48.

Mounting system 10 defines a universal mounting platform whereon components to an HVAC system are mounted. When first rail section 20 and second rail section 40 are coupled, a component platform 64 is created that supports the perimeter of certain HVAC components. An A-coil, a heating element, or an air filter for instance, can be attached to mounting system 10 to become integrated into a particular HVAC system.

Understanding the utility of the present embodiment requires an overview of the function and purpose of common HVAC systems. It is also beneficial to be familiar with the certain scenarios encountered when installing mounting system 10 in a given HVAC system.

Figure 5:
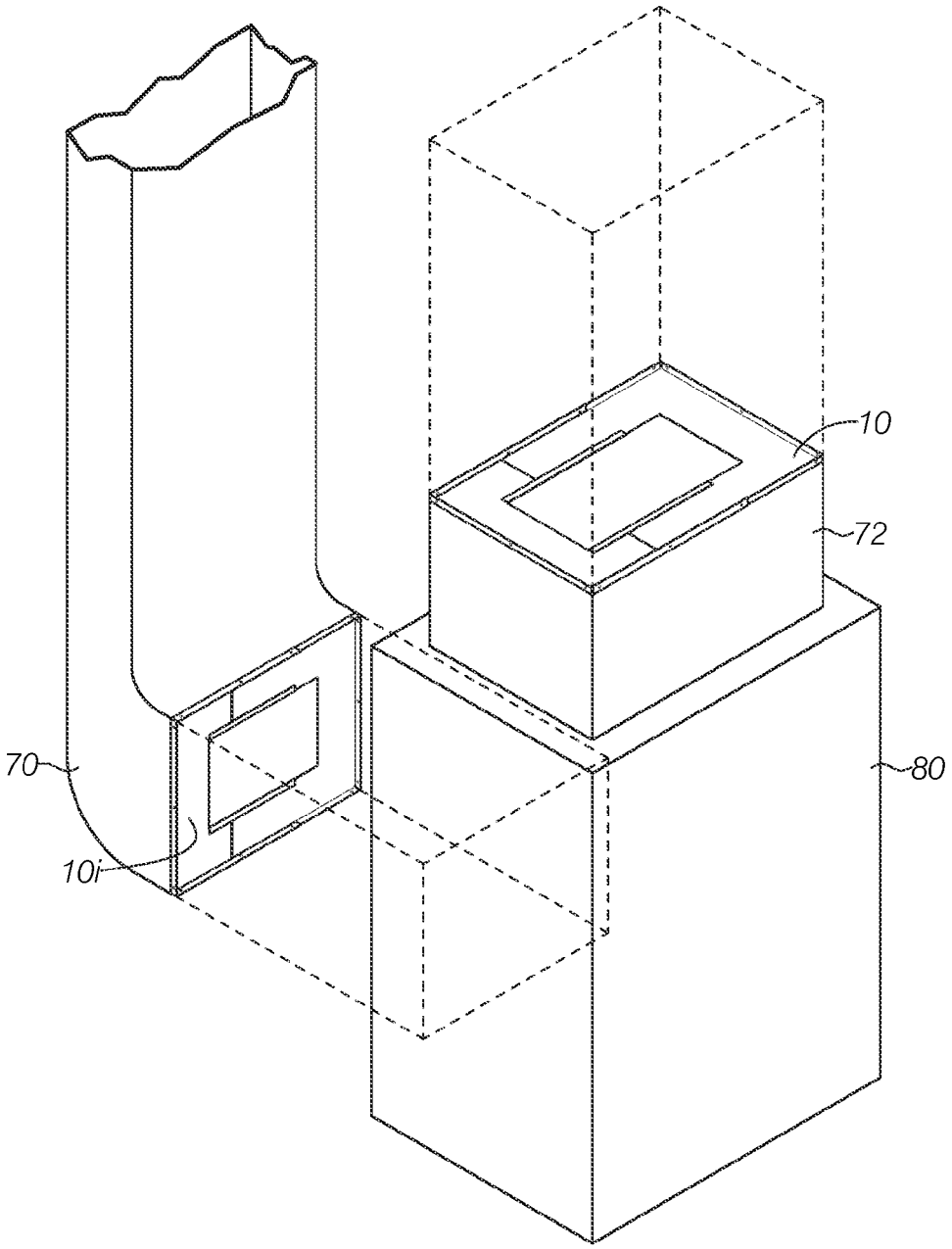
FIG. 5 is a perspective view of a sample HVAC system incorporating the universal HVAC component mounting system shown in FIG. 1.
Figure 6:
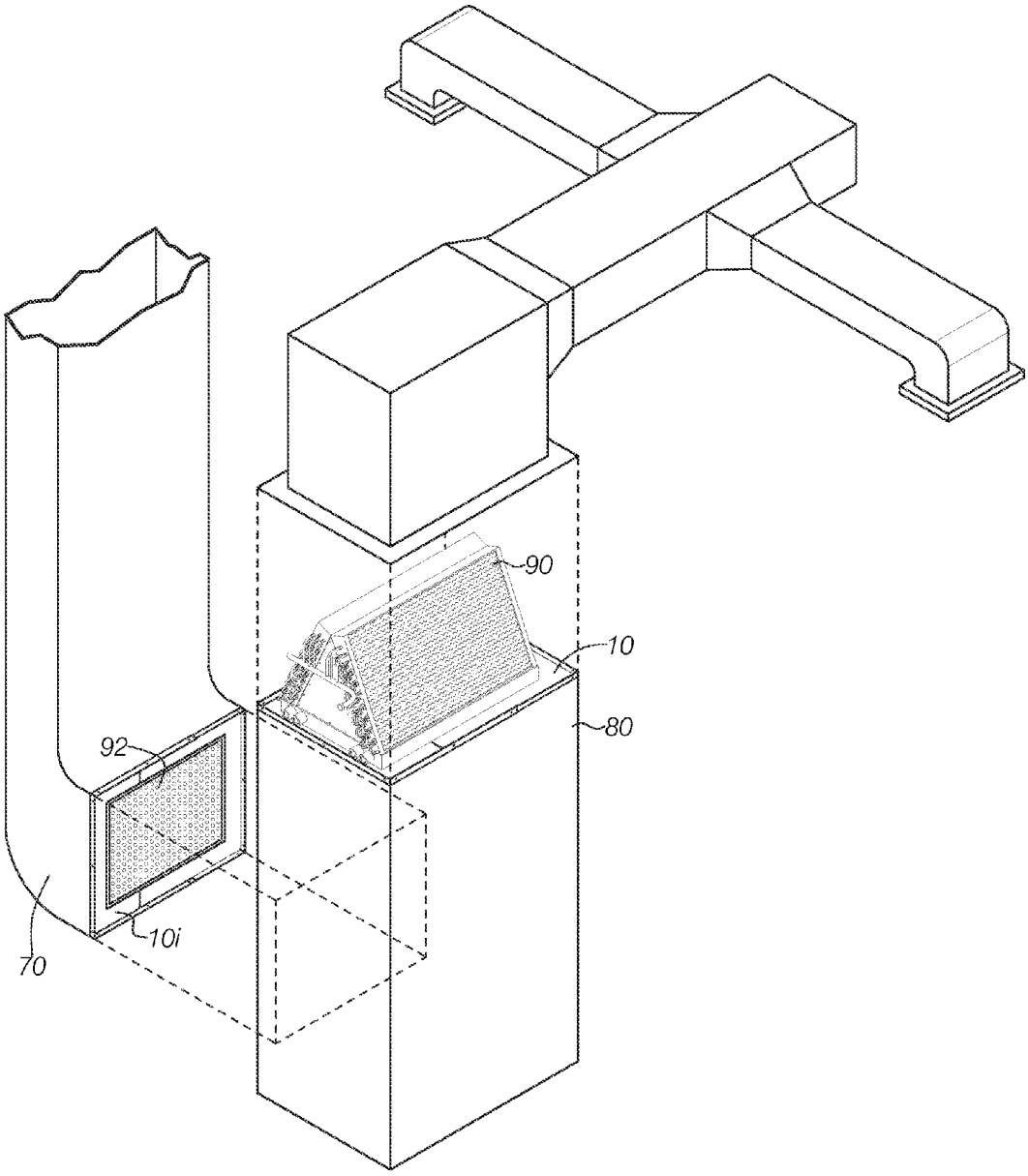
FIG. 6 is a perspective view of a sample HVAC system incorporating the universal HVAC component mounting system shown in FIG. 1 to mount an A-coil and an air filter.

HVAC systems and the related components are varied. Mounting system 10 therefore is configured to adjust its width to fit a variety of HVAC installation scenarios. FIGS. 5 and 6 for example show mounting system 10 selectably adapted to mount within an intake plenum 70, a main plenum 72, and a furnace 80.

The relative sizes of the duct work that mounting system 10 must fit within are not constant. Thus, an adjustable mounting platform is able to be quickly installed and eliminates the need for customizing platforms on-site. Mounting system 10 can slide together to be inserted into intake plenum 70, for example, and then extended to the plenum's width for mounting.

In addition to the varying sizes of duct work that mounting system 10 must fit within, HVAC components that utilize mounting system 10 are also not uniform in shape and size. FIG. 6 shows an A-coil 90 mounted on top of mounting system 10 in furnace 80. The base of A-coil 90 has a width and length that is less than that of the furnace plenum, but greater than that of first rail section 20 and second rail section 40. In this way, A-coil 90 is able to rest within furnace 80 and mounting system 10 is able to adjust to the width and length of furnace 80.

FIG. 6 also shows mounting system 10(*i*) alternatively mounted within intake plenum 70. Intake plenum 70 has a width and length that is different than that of furnace 80. Mounting system 10(*i*) is also configured to receive an HVAC component, in the form of air filter 92, that has a width and length different than that of A-coil 90.

Mounting system 10*i* therefore, is selectably configured to conform to the width of intake plenum 70 while still providing a base sufficient to receive air filter 92.

HVAC system components often function by having forced air passed through the component structure to interface with some surface of the component. A-coil 90, for instance, has outside air and return air forced through the metal coils contained in its body. Heat from the passing air is captured by the coils and evacuated in the coolant contained inside the coils.

Similarly, air is passed through air filter 92 and particulate matter in the air is removed as it contacts the filter surface and is kept from passing through.

Mounting system 10 is therefore configured to allow air to pass freely through an aperture 23, central to the mounting system 10. In the instant example, mounting system 10 is made from sheet metal. In another embodiment the mounting system is made from steel. In yet another embodiment the mounting system is made from any material adequate to support a given HVAC component and endure the temperature changes of a given HVAC system.

Figure 2:
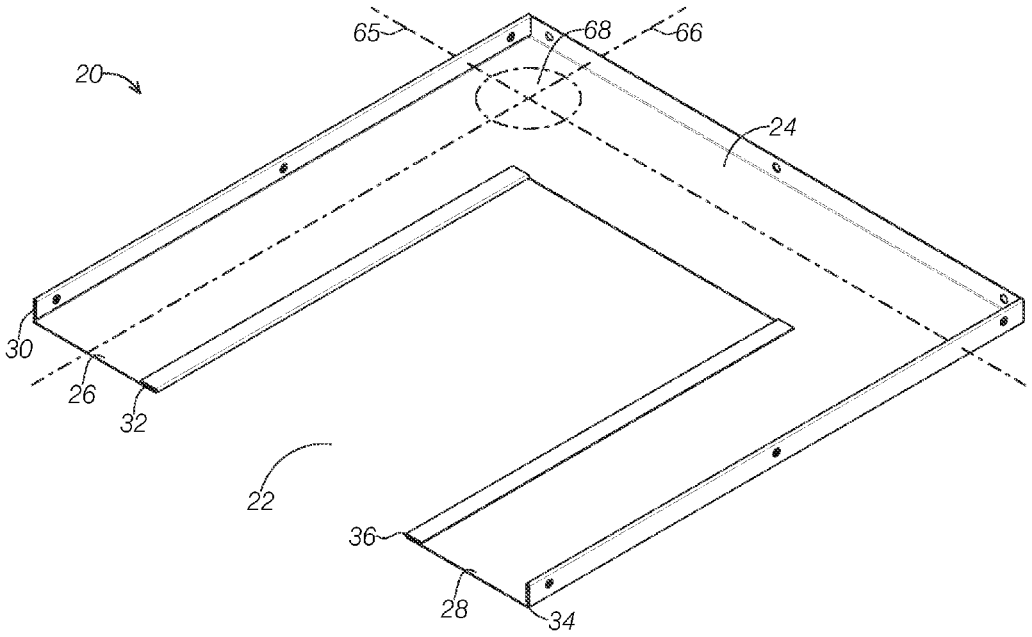
FIG. 2 is a perspective view of a first receiving section of the universal HVAC component mounting system shown in FIG. 1.

Turning our attention now to FIG. 2, first rail section 20 will now be described. First rail section 20 includes a first support bracket 24.

In the instant embodiment first support bracket 24 is an elongate member that is substantially planar and provides a flat surface area for interfacing a given HVAC component. First support bracket 24 also provides a structural support from which first receiving member 26 and second receiving member 28 extend.

In this embodiment first support bracket 24 extends on a first axis 65 transverse to, but in the same plane 68 as, that of first receiving member 26 and second receiving member 28. Receiving member 26 is disposed along first support bracket 24 extending somewhat perpendicular to the first support bracket 24.

First receiving member 26 is spaced from second receiving member 28 along first support bracket 24 by central opening 22, both receiving members extending in the same direction, the entire structure forming a U-shape.

In the instant embodiment, first receiving member 26 is an elongate arm providing a flat surface similar to that of first support bracket 24, on which a given HVAC component may rest. First receiving member 26 further includes a lateral channel 30 and a medial channel 32.

In the instant example, lateral channel 30 is disposed along the edge of first receiving member 26 opposite central opening 22. In this example, lateral channel 30 defines a space created by the folding over of the lateral edge of first receiving member 26 and configured to slidingly receive a lateral glide 54 of second rail section 40.

In another example, the lateral channel is a depression in the surface of the first extension member configured to slidingly engage the lateral glide of the second rail section. In various other embodiments the lateral channel is any engaging member capable of slidingly interfacing the second rail section.

Referring again to FIG. 2, a medial channel 32 is introduced. Medial channel 32 is disposed along the medial edge of the first receiving member 26 on the side proximate the central opening 22.

Similar to lateral channel 30, medial channel 32 in this embodiment consists essentially of a channel created by the folding over of the sheet metal along the medial edge of first receiving member 26. Medial channel 32 defines a space into which a medial glide 56 of second rail section 40) slides.

In other examples, the medial channel is any structure disposed along the medial edge of a receiving member capable of slidingly engaging a medial glide.

FIG. 2 shows second receiving member 28 spaced from first receiving member 26 on an opposite end of first support bracket 24 to form a U-shaped first rail section 20. In the instant example, first receiving member 26 is a mirror-image of second receiving member 28. Second receiving member 28 includes a lateral channel 34 and a medial channel 36 substantially the same as those of first receiving member 26.

Figure 3:
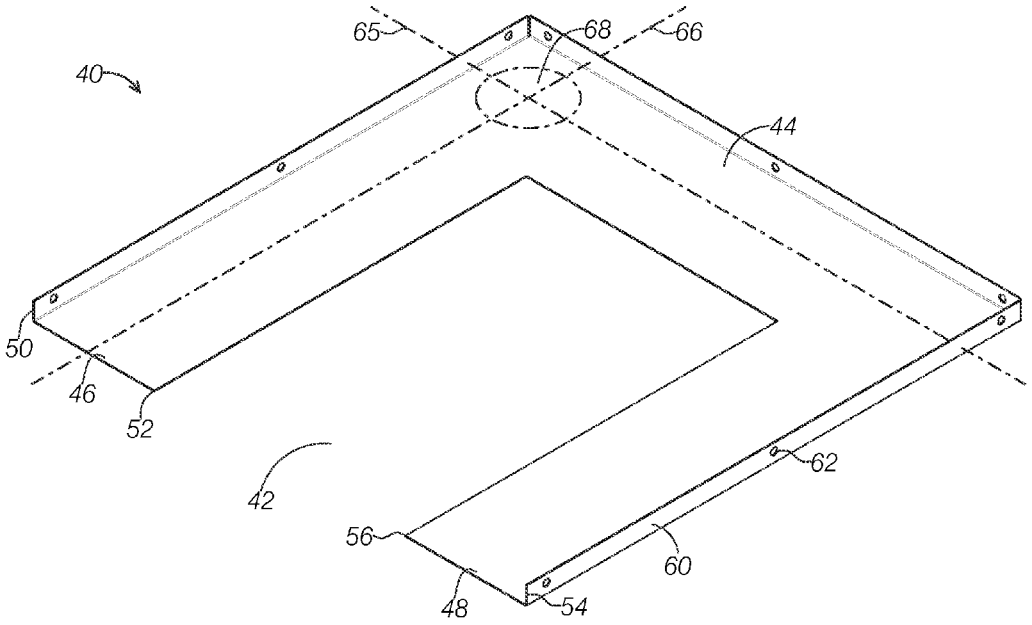
FIG. 3 is a perspective view of a first inserting section of the universal HVAC component mounting system shown in FIG. 1.

Turning now to FIG. 3, second rail section 40 will now be described. Second rail section 40 has a shape complimentary to that of first rail section 20. Second rail section 40 includes a central opening 42, a second support bracket 44, a first inserting member 46, and a second inserting member 48.

Second rail section 40 is similar to first rail section 20. Central opening 42, second support bracket 44, first inserting member 46, and second inserting member 48 are structures that are substantially the same as their counterparts described in conjunction with first rail section 20 and will not be redundantly described.

In the instant embodiment, the key distinguishing feature between first rail section 20 and second rail section 40 is the respective receiving and inserting functions. While the first receiving member 26 and the second receiving member 28 are flanked by a lateral and medial channel, the first inserting member 46 and the second inserting member 48 are flanked by lateral and medial glides.

First inserting member 46 for instance, extends on an axis 66 that is co-planar with, but transverse to, axis 65 of second support bracket 44. Second inserting member 48 is spaced from first inserting member 46 on an opposite end of second support bracket 44 and separated by central opening 42.

First inserting member 46 includes a lateral glide 50 disposed lengthwise on the lateral edge of first inserting member 46 opposite central opening. In the instant embodiment lateral glide 50 is a metal edge configured to slidingly engage lateral channel 34 of second receiving member 28.

In another embodiment the lateral glide may be any protrusion from the lateral edge of an inserting member, capable of slidingly engaging an opposing channel.

A medial glide 52 is disposed along the edge of first inserting member 46 opposite the lateral glide and proximate central opening 42. Medial glide 52 is a metal edge configured to insert into medial channel 36 of second receiving member 28.

Second inserting member 48 extends parallel to first inserting member 46 and transverse to second support bracket 44 forming a U-shaped second rail section 40.

Second inserting member 48 includes a lateral glide 54 and a medial glide 56. Second inserting member 48 and its subcomponents are substantially the same as first inserting member 46 and will not be redundantly explained.

Second rail section 40 slidingly engages first rail section 20 by aligning its lateral and medial glides with the lateral and medial channels of first rail section 20. The engaged sections create an aperture 23 where central opening 22 and central opening 42 are merged.

Figure 4:
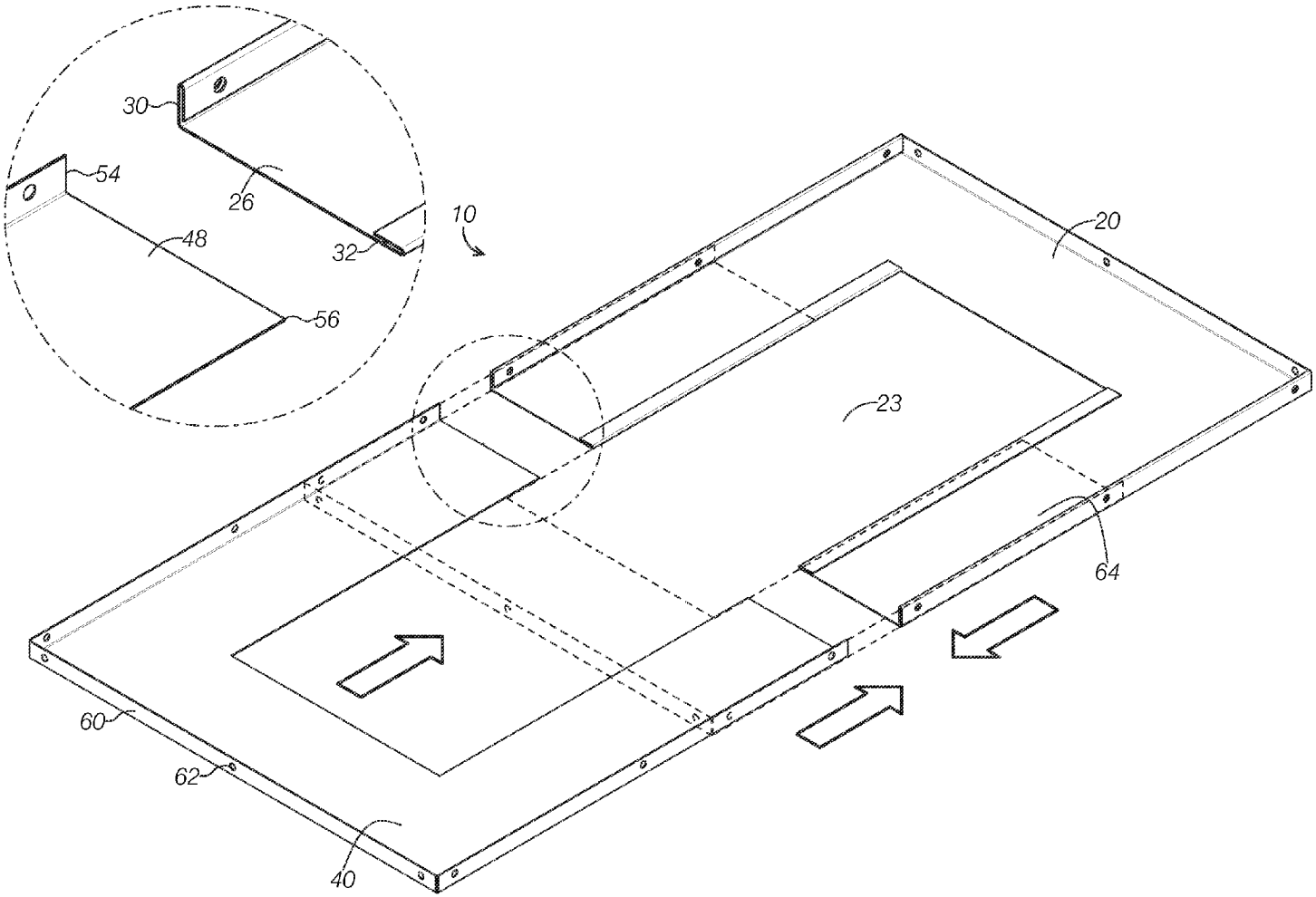
FIG. 4 is a perspective view of the first receiving section and the first inserting section of the universal HVAC component mounting system shown in FIG. 1 further depicting the engagement of the individual sections.

Turning our attention to FIG. 4, the engaged first rail section 20 and second rail section 40 are drawn together to create a component platform 64. Component platform 64 is adjustable by sliding second rail section 40 into first rail section 20 causing second support bracket 44 to move closer to first support bracket 24.

Adjusting the effective width of component platform 64 and the opening size of aperture 23 allow a user selectable size for varying HVAC installation scenarios.

FIG. 4 also shows that component platform 64 includes a fastening surface 60. In the instant example, fastening surface 60 surrounds the perimeter of platform 64. Fastening surface 60 further includes a plurality of fastening holes 62. Fastening holes 62 are configured to receive a fastener for attaching fastening surface 60 to a given section of an HVAC system.

FIG. 5 for example, shows mounting system 10 fastened within HVAC plenum 72. Here, fastening surface 60 interfaces with the interior surface of the plenum. In this example, a sheet metal screw is used to fasten mounting system 10 to the plenum 72. In another example a threaded bolt is used. In yet other examples, any fastener capable of supporting the mounting system 10 and fastening it to the wall of a given HVAC system is used.

Often, HVAC systems and related ductwork and plenum come pre-drilled to accept the fasteners for HVAC components and HVAC mounting systems. In the present example, mounting system 10 is configured such that mounting holes 62 are aligned with the pre-drilled fastening holes of the sample HVAC system. In another example the mounting holes are spaced randomly along the fastening surface and do not interface with existing holes in the HVAC system. In yet other examples the fastening surface is not pre-drilled and is custom drilled on site.

Figure 7:
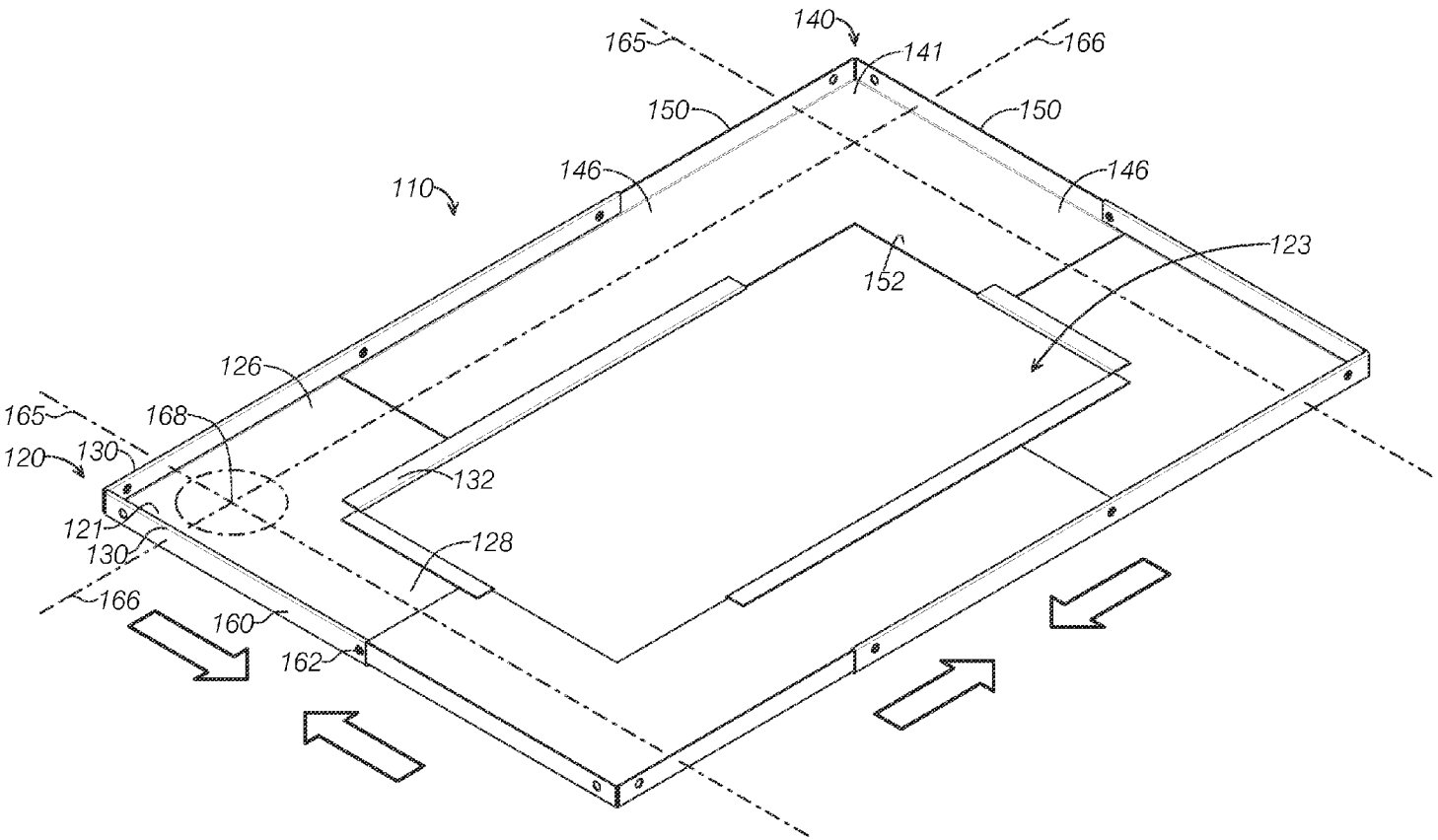
FIG. 7 is an alternative embodiment of a universal HVAC component mounting system configured to adjust effective length and effective width.

Turning attention to FIG. 7, a second example of a HVAC component mounting system 110 will now be described. Mounting system 110 includes many similar or identical features to mounting system 10. Thus, for the sake of brevity, each feature of mounting system 110 will not be redundantly explained. Rather, key distinctions between mounting system 110 and mounting system 10 will be described in detail and the reader should reference the discussion above for features substantially similar between the two systems.

As can be seen in FIG. 7, mounting system 110 includes a modular platform 112, enclosing a central aperture 123, a first platform section 120 and a second platform section 140.

In this embodiment, modular platform 112 defines an HVAC mounting platform configured to conform its effective width and length to a particular HVAC application. The ability of modular platform 112 to adjust length and width is a function of the slidingly engaged first platform section 120 and the second platform section 140.

Platform section 120 is similar in many respects to first rail section 20 described above. In the instant embodiment platform section 120 further includes a platform section body 121, a first member 126 extending from platform section body 121 on a first axis 166, a second member 128 extending from the platform section body 121 on a second axis 165 transverse to but in a same plane 168 with first axis 166.

In the instant example, first member 126 and second member 128 include a medial channel 132 disposed along the medial edge of platform section 121) proximate central aperture 123. In another example, the medial channel is disposed only along the medial edge of the first member. In an alternate example the medial channel is disposed only along the medial edge of the second member.

Likewise, the lateral edge of first platform section 120 includes a lateral channel 130. Lateral channel 130 is disposed along the lateral edge of first member 126 and second member 128 opposite central aperture 123. Lateral channel 130 is configured to receive an opposing lateral glide 150 from an adjacent second platform section 140, the sliding engagement of the glides and channels creating the adjustable modular platform 112.

Second platform section 140 is similar in many respects to first platform section 120 and second rail section 40 above. In the instant embodiment, second platform section 140 further includes a platform section body 141, a first member 146 extending from platform section body 141 on first axis 166, a second member 148 extending from the platform section body 141 on second axis 165 transverse to, but within plane 168 with first axis 166.

In the instant example, first member 146 and second member 148 include a medial glide 152 disposed along the medial edge of platform section 140 proximate central aperture 123. In another example, the medial glide is disposed only along the medial edge of the first member. In an alternate example, the medial glide is disposed only along the medial edge of second member 148.

Likewise, the lateral edge of second platform section 140 includes a lateral glide 150. Lateral glide 150 is disposed along the lateral edge of first member 146 and second member 148 opposite central aperture 123. Lateral glide 140 is configured to insert into an opposing lateral channel 130 from an adjacent first platform section 120, the sliding engagement of the glides and channels creating the adjustable modular platform 112.

Referring again to FIG. 7, the engaged lateral channel 130 with lateral glide 150 forms a fastening surface 161) similar to that described in the alternative embodiment above. Fastening surface 160 further includes mounting holes 162. In the instant example, mounting holes 162 are pre-drilled and configured to align with holes commonly placed in a given HVAC system. In alternative embodiments, mounting holes are custom drilled on-site and are not configured to conform to any pre-existing pattern.

In various examples and embodiments configured to adjust effective platform width and length, the platform sections slidingly engage and the central aperture size is adjusted. Engaging the slides and channels of adjacent platform sections towards one another conforms platform size to a smaller HVAC component and system. Slidingly adjusting the glides and channels of adjacent platform sections away from one another conforms the size of the modular platform to a larger HVAC component or system.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A universal system for mounting HVAC components within an HVAC system, comprising:

a first rail section configured to mount within an HVAC system and defining a receiving section, the first rail section including:

a receiving member defining a channel and extending along a first axis;

a first support bracket adjacent to the receiving member and extending along a second axis transverse to the first axis;

a second rail section having a shape complimentary to the first rail section and defining an inserting section configured to slidingly engage the first rail section, the second rail section including:

an inserting member defining a glide and extending along the first axis; and a second support bracket adjacent to the inserting member, and extending along a third axis substantially parallel to the second axis;

wherein the glide of the second rail section is configured to slide into the channel of the first rail section to move the first support bracket closer to the second support bracket.

2. The universal mounting system of claim 1, wherein the receiving member defines a first receiving member and wherein the first rail section further includes a second receiving member and wherein the inserting member defines a first inserting member and wherein the second rail section further includes a second inserting member.

3. The universal mounting system of claim 2, wherein: each receiving member includes:

a first channel disposed on a lateral edge of the member and extending lengthwise along the first axis; and a second channel disposed on a medial edge of the member and extending lengthwise along the first axis; and each inserting member includes:

a first glide configured to slidingly engage the first channel and disposed on a lateral edge of the inserting member lengthwise along the first axis substantially in line with the first channel; and a second glide configured to slidingly engage the second channel and disposed on a medial edge of the inserting member lengthwise along the first axis substantially aligned with the second channel.

4. The universal mounting system of claim 3, wherein the first rail section includes a first receiving member spaced from a second receiving member along the first support bracket, and wherein the second rail section includes a first inserting member spaced from a second inserting member along the second support bracket.

5. The universal mounting system of claim 4, wherein the first and second rail sections are slidingly engaged to define a component platform.

6. The universal mounting system of claim 5, wherein the component platform is configured to adjust in length by sliding the first rail half and the second rail half towards one another along the first axis.

7. The universal mounting system of claim 6, wherein the component platform surrounds an open space through which air flows through the HVAC system.

8. The universal mounting system of claim 1, further comprising a fastening surface disposed on the periphery of the first and second rail sections.

9. The universal mounting system of claim 8, wherein the fastening surface includes a plurality of fastening holes.

10. The universal mounting system of claim 9, wherein the fastening holes are spaced from one another to correspond with an opposing hole configuration formed in the HVAC system.

11. The universal mounting system of claim 1, wherein the HVAC system defines a furnace.

12. The universal mounting system of claim 1, wherein the first and second rail sections are mounted within the HVAC system plenum.

13. The universal mounting system of claim 1, wherein the first and second rail sections support an HVAC component.

14. The universal mounting system of claim 13, wherein the HVAC component is an A-Coil.

15. A universal mounting system for HVAC components, comprising:

a first rail section configured to mount within an HVAC system and defining a receiving section, the first rail section including:

a central opening;

a first support bracket disposed on the periphery of the central opening;

a first receiving member extending lengthwise perpendicularly from the first support bracket, the first receiving member including:

a lateral channel disposed lengthwise along the outer edge of the receiving member relative to the central opening; and a medial channel disposed lengthwise along the inner edge of the receiving member relative to the central opening; and a second receiving member substantially similar to the first receiving member and extending perpendicularly from the first support bracket parallel to the first receiving member, the second receiving member being spaced from the first receiving member;

a second rail section having a shape complimentary to the first rail section and defining an inserting section configured to slidingly engage the first rail section, the second rail section including:

a central opening;

a second support bracket disposed on the periphery of the central opening, a first inserting member extending lengthwise perpendicularly from the second support bracket, the first inserting member including:

a lateral glide configured to engage the lateral channel of the first receiving member, disposed lengthwise along the outer edge of the inserting member relative to the central opening;

a medial glide configured to engage the medial channel of the first receiving member and disposed lengthwise along the inner edge of the inserting member relative to the central opening; and a second inserting member substantially similar to the first inserting member and configured to slidingly engage the second receiving member, the second inserting member extending perpendicularly from the second support bracket parallel to the first inserting member, and being spaced from the first inserting member.

16. The universal mounting system of claim 15, wherein the first and second rail sections are slidingly engaged to define a component platform.

17. The universal mounting system of claim 16, wherein the width of the component platform is configured to adjust by sliding the first rail section toward the second rail section.

18. The universal mounting system of claim 16, wherein the component platform supports an HVAC component.

19. The universal mounting system of claim 18, wherein the HVAC component is an A-coil.

20. The universal mounting system of claim 15, wherein the first and second rail sections are mounted in an intake plenum of the HVAC system.

21. A universal mounting system for HVAC components, comprising:

a modular platform configured to mount within an HVAC system, the modular platform defining a substantially planar body adjustably configured to conform its effective width and length to that of the HVAC system and including:

a plurality of platform sections including a first platform section and a second platform section, each platform section in the plurality of platform sections having:

a platform section body;

a first member extending from the platform section body along a first axis within a plane; and a second member adjacent to the first member extending from the platform section body along a second axis within the plane, the second axis being transverse to the first axis;

wherein the first member and the second member of the first platform section are configured to slidingly engage the first member or the second member of the adjacent second platform section.

22. The universal mounting system of claim 21, wherein the first platform section defines a receiving section and the second platform section defines an inserting section.

23. The universal mounting system of claim 21, wherein the plurality of platform sections enclose a central aperture and wherein the first platform section further includes:

a medial channel disposed along the medial edges of the first member and the second member adjacent to the central aperture;

a lateral channel disposed along the lateral edges of the first member and the second member opposite the central aperture; and wherein the second platform section further includes:

a medial glide disposed along the medial edges of the second member adjacent to the central aperture; and a lateral glide disposed along the lateral edges of the second member opposite the central aperture.

* * * * *